United States Patent [19]

Dischler

[11] Patent Number: 4,798,073

[45] Date of Patent: Jan. 17, 1989

[54] BENDING MACHINE FOR BENDING BARS, CHANNELS, SECTIONS AND THE LIKE

[76] Inventor: Helmut Dischler, Droste-Heuelshoff-Str. 9, D-4040 Neuss, Fed. Rep. of Germany

[21] Appl. No.: 941,650

[22] Filed: Dec. 15, 1986

[51] Int. Cl.[4] ..... B21D 11/04

[52] U.S. Cl. ..... 72/218; 72/217; 72/388; 72/219; 72/387; 72/453.15; 72/453.16; 72/450

[58] Field of Search ..... 72/215, 216, 217, 218, 72/219, 387, 388, 383, 453.15, 453.16, 450, 451

[56] References Cited

U.S. PATENT DOCUMENTS

| | | | |
|---|---|---|---|
| 2,414,926 | 1/1947 | Burke | 72/217 |
| 2,696,939 | 12/1954 | Courtney | 72/451 |
| 2,756,428 | 7/1956 | Kellersman | 72/451 |
| 3,438,237 | 4/1969 | Sisler | 72/217 |
| 3,606,786 | 4/1969 | Taylor | 72/217 |
| 3,803,893 | 4/1974 | Peddinghaus et al. | 72/217 |
| 4,425,781 | 1/1984 | Oetiker | 72/218 |
| 4,597,279 | 7/1986 | Lisec | 72/388 |
| 4,604,885 | 8/1986 | Lang | 72/388 |

FOREIGN PATENT DOCUMENTS

| | | | |
|---|---|---|---|
| 537904 | 10/1931 | Fed. Rep. of Germany . | |
| 1881368 | 8/1963 | Fed. Rep. of Germany . | |
| 1652822 | 9/1971 | Fed. Rep. of Germany . | |
| 2918813 | 11/1980 | Fed. Rep. of Germany | 72/217 |
| 200127 | 3/1983 | Fed. Rep. of Germany | 72/215 |
| 607617 | 5/1978 | U.S.S.R. | 72/217 |
| 721162 | 3/1980 | U.S.S.R. | 72/217 |
| 1298666 | 12/1972 | United Kingdom | 72/217 |

*Primary Examiner*—David Jones

*Attorney, Agent, or Firm*—Shlesinger, Arkwright & Garvey

[57] ABSTRACT

A bending machine comprises a support to which first and second spaced cooperating bending devices are displaceably mounted. Each of the bending devices comprises first and second spaced cooperating bending components and the components of the first and second bending devices define a first axis extending between the bending devices and further define second and third axes extending generally transverse to the first axis and about which a length to be bent may pivot and each of the second and third axes are disposed between the components of one of the bending devices. A drive mechanism is operably associated with at least one of the components of each of the bending devices for causing displacement thereof. A guide system is operably associated with the support and with each of the bending devices so that displacement of the bending components by the drive system causes the bending components to move relative to the first axis and to engage the length to be bent extending between the devices. The guide system further permits the bending means to move along the guide system relative to each other so that the length is bent intermediate the bending devices.

17 Claims, 4 Drawing Sheets

BENDING MACHINE FOR BENDING BARS, CHANNELS, SECTIONS AND THE LIKE

BACKGROUND OF THE INVENTION

This invention concerns a procedure for bending extruded lengths, in particular wires, tubes, cables, drawn or extruded lengths, sections and the like. It further concerns a bending machine, to carry out this procedure, utilizing two mutually spaced bending devices, each comprising at least two bending components and drives to move at least one of the bending components essentially transversely to the length being bent.

Such bending machines are described in the German Offenlegungsschrift No. 16 52 822 and in the German Pat. No. 537,904. They comprise two or more bending devices next to each other each with two bending components. In the bending machines of the first cited document, the spacing between the bending devices is also adjustable so that bending can be carried out at mutually different spacings.

The German Gebrauchsmuster No. 18 81 368 discloses a further bending machine comprising a bending device with roller-shaped bending components. Also, roller guides are provided for the wire to be bent.

In all previously known bending machines, the length of material is bent by applying a curving force to the bending components. The inside bending radius then corresponds to the radius of the bending components. Large bending radii, about the size of the particular bending device and above, cannot be achieved in such bending methods. Furthermore, the components must be exchanged, when bending radii or different sizes are required, for those with the proper radius.

The object of the invention therefore is to discover a procedure permitting large bending radii to be formed while using compact bending machines, and where no conversion of the bending machine is necessary when producing bends with different radii.

This problem is solved by the invention in that the length of extruded material will be curved in opposite directions at two mutually spaced sites, and simultaneously about two mutually parallel axes which are transverse to the longitudinal axis of the extruded length, essentially without other substantial forces.

In this manner, the length to be bent is subjected to a curving or bending moment acting transversely to the longitudinal axis of this length, and this is done by a pair of forces applied at two spaced sites. Due to the application of such a bending torque, the length then bends freely and uniformly in the space between the two bending devices. A bending radius is obtained which, unlike the case for the known bending machines, will not depend on the diameter of the bending components, but rather on the spacing of the bending devices at the beginning of the bending procedure. The larger this separation, the greater the bending radius.

To carry out the procedure of the invention, there are basically two alternatives. One alternative is characterized in that the drives operate in opposite directions, and in that the bending components each are provided with a freely rotating sleeve. Another solution consists in the drives again operating oppositely and at least one of the bending devices is displaceably guided during the bending procedure in a plane perpendicular to the axes of rotations, and relative to the other device to impart a torque without additional forces.

In both solutions, the torque is applied in the absence of additional forces by simultaneous drives operating oppositely for each of at least one of the bending components. In the first cited solution, the length to be bent is kept free from any additional forces by the roller-shaped design of the bending components because the length may slip through the bending components while being bent. As regards the last cited solution, no relative motion between the length and the bending components takes place because the bending devices are guided in such a manner that their spacing decreases in relation to the progress in bending. The latter embodiment is especially applicable when bending lengths with rough surfaces, such as construction steel, because such materials would hardly slip between the bending components of the first solution. In the second solution, the occurrence of additional forces is avoided by the relative motion of the two bending devices during the bending procedure.

Obviously both solutions may be combined, that is, the displaceable guidance of the bending devices may be combined with roller-like bending components.

If always the same bending radii are to be made using the bending machine of the first solution, then it suffices to keep the bending devices a fixed distance apart. If, however, this spacing is varied, then it will be possible to make correspondingly different bending radii. This can be achieved, on one hand, in that the bending devices are fixed in place at diverse spacings. Alternatively, at least one of the two bending devices, but especially both, shall be guided freely. This alternative also is applicable to the second solution. In that case, the spacing between the two bending devices can be set automatically in such a manner that only bending torques, but no further forces are transmitted to the lengths to be bent. As a result, a neat arc of circle is achieved, provided that the material involved is uniform in its moment of inertia with respect to length, and this shall be the case as a rule. Therefore, the bending machine of the invention also may be appropriately used to test inhomogeneities in the lengths. If, due to inhomogeneity, there is a lesser moment of inertia at one place in the length, then a clearly visible and smaller arc shall be formed there.

Appropriately the bending device(s) shall be displaceably mounted in a guide slot which, illustratively may be provided in a bench.

The bending components can be moved transversely to the lengths in a simple manner, known per se, using a rotary drive. The bending components then can be mounted on a rotary disk. Alternatively and obviously, there is also the possibility of directly connecting the bending components to linear actuators for carrying out the transverse motion. The term linear actuator especially includes hydraulic or pneumatic cylinders, also spindle drives or the like.

The flexibility of the bending machine of the invention may be further enhanced by each bending device comprising its own, separately reversible drive. As a result, the rotational shafts can be driven not only oppositely, but also in the same direction, or only one of them might be. In this manner manifold bendings can be carried out.

In lieu of a guide slot, special constrained guide means may be provided to cause the change in separation required to apply the bending torque in the sense of the second solution. This can be implemented in simple manner, in that each of the bending devices is mounted to a pivot system which is pivoted relative to the other(s) by at least one drive means. The pivot systems each may consist of two guide links forming a four-joint kinematics. Appropriately the guide links always are parallel to one another, whereby the particular four-joint kinematics shall form a parallelogram. A simple design is given when the guide links are hinged to the bending devices at the shafts of the bending component.

In order that the guide links and hence the bending devices will always be mounted with mirror-symmetry to each other, one guide link of one bending device shall be synchronized by a gear unit with a guide link of the other bending device. This can be implemented in simple manner by two mutually meshing gears or gear sectors. The gear transmission will be especially simple if one of the guide links rests in the pivot axis of the associated four-joint kinematics, so that its hinge point performs only a motion of rotation.

To make possible simple displacement of the two four-joint kinematics, they should be suspended from a pivotably supported drive bar, preferably in a V-arrangement with close-by pivot axis.

The free ends of the drive bars can be connected to the drive motor. It was found appropriate, in this respect, to connect the drive bars to two pressure bars which are joined together and form a link quadrilateral acted on by the drive motor. In this embodiment, both bending devices are operated from a single drive motor, which represents an advantageous design for a hand tool because of weight savings. In that case, the drive motor illustratively is a pressure cylinder with return spring. However other drives, for instance electrical ones, or exceptionally, hydraulic ones, also may be used.

Regardless of the manner in which the two bending devices are being moved, it may be appropriate that one bending component of each bending device be located in the pivot axis and therefore act only as a bearing. In that case only, one of the bending components will be moved transversely to the lengths being bent.

The versatility of the bending machine is further enhanced when the bending components are mounted in exchangeable manner, whereby bending components of various diameters can be mounted. Again, the spacing between the bending components of each bending device shall be adjustable to further improve adaptability.

A further feature of the invention provides that the bending components conically taper toward their free ends. This makes it possible to insert the lengths to be bent without play between the bending components. In this manner, uniform bending at equal angles of rotation may be achieved, regardless of material thickness.

Lastly the invention provides mounting a compression piece between the bending devices, in order to prevent an arc of circle to be formed, whereby a U bend with straight connections between the corner bends can be made.

The invention is shown in closer detail by the illustrative embodiments of the drawings.

Figure 1:
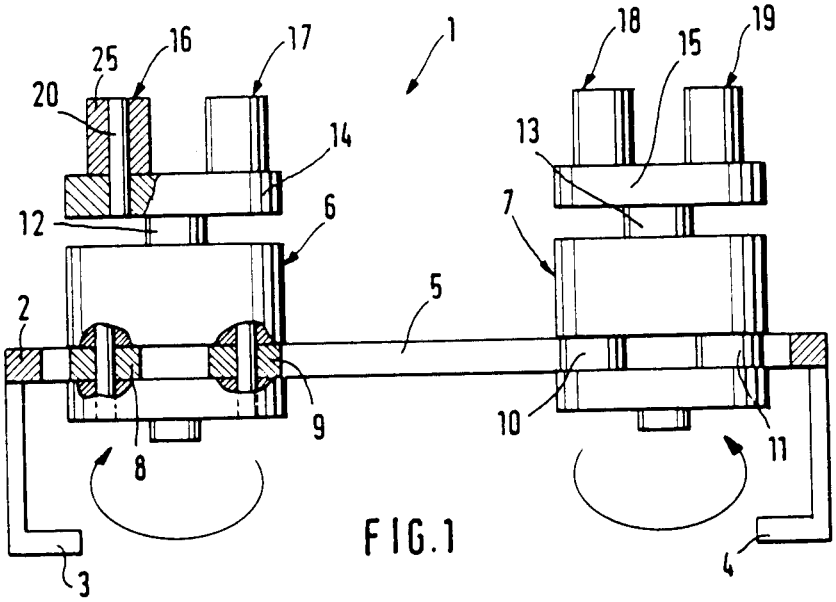
FIG. 1 is a sideview, including partial sections, of a bendiang machine.
Figure 2:
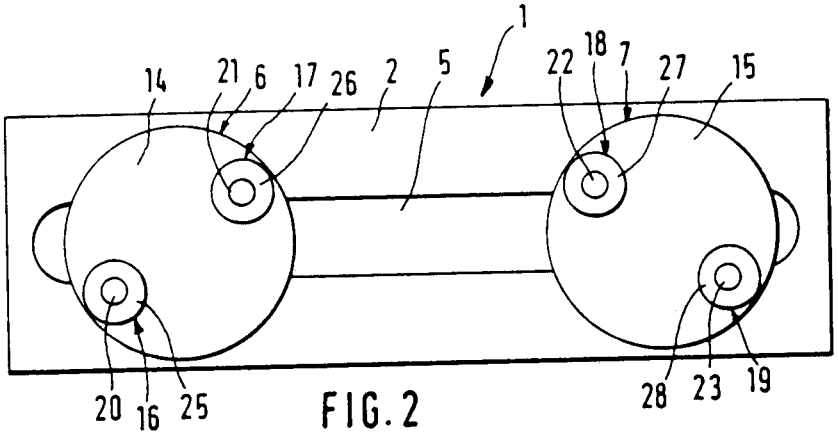
FIG. 2 is a top view of the bending machine of FIG. 1.

The bending machine 1, as best shown in FIGS. 1 and 2, comprises a bench 2 with welded-on feet 3, 4. The bench 2 includes a straight slot 5 within which two bending devices 6, 7 are guided in easily displaceable but irrotational manner. This is accomplished by two rollers 8, 9 and 10, 11 mounted symmetrically with the center axis and of which the diameter corresponds to the width of the slot 5.

One rotary drive, for instance an electric motor with a gear unit or a hydraulic actuator, is mounted in each of bending devices 6, 7. The drives actuate shafts 12 and 13, respectively of which the ends thereof hold rotary disks 14 and 15, respectively. The rotary disks hold two bending components 16, 17 and 18, 19, respectively extending parallel to the axes of rotation of the shafts 12, 13. Each consists of a shaft 20, 21 or 22, 23 connected to the rotary disk 14 or 15 and of a roller 25, 26 or 27, 28 mounted thereon. The rollers 25, 26 and 27, 28 pivot about the shafts 20, 21 and 22, 23 respectively.

Figure 3:
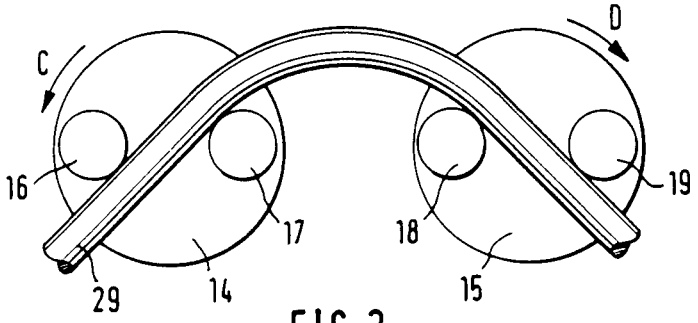
FIGS. 3 and 4 show the bending machine of FIGS. 1 and 2 when bending a wire.
Figure 4:
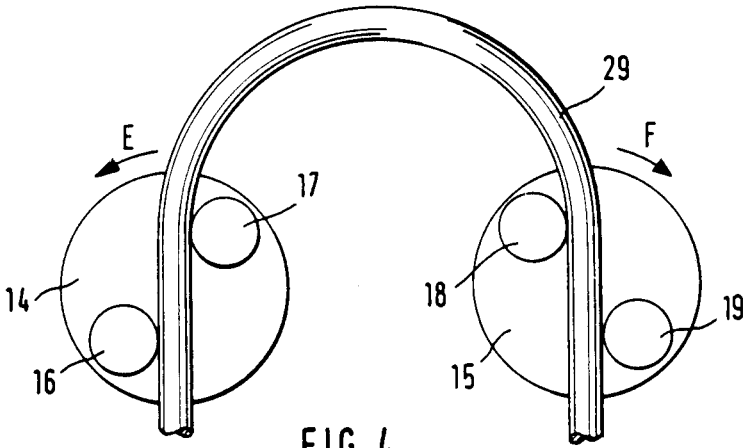

FIGS. 3 and 4 show the main modes of operation of the bending machine of FIGS. 1 and 2, namely as top views of the two bending devices 6, 7 or their rotary disks with the bending components 16, 17 and 18, 19. For the sake of clarity, the bench 2 is omitted.

Basically the rotary disks 14, 15 are initially in the position shown in FIG. 2, so that a length to be bent, for instance a wire 29, can be inserted between the bending components 16, 17 and 18, 19. If now the two rotary disks 14, 15 are driven simultaneously and oppositely, as indicated in FIGS. 3 and 4 by the arrows C, D, E, F, then the bending components 16, 17 and 18, 19 are moved essentially transversely to the wire 29, and thereby a bending torque is applied to the wire 29 which thereby begins to freely bend. In this process, the spacing between the two rotary disks 14, 15 decreases automatically until the U shape shown in FIG. 4 is achieved. The bending radius depends on the distance between the rotary disks 14, 15 at the beginning of the bending procedure.

However, the wire 29 also can be bent while the spacing between the two rotary disks 14, 15 remains fixed. The circumstance that the spacing between the rotary disks 14, 15 no longer can be altered during the bending procedure is replaced by the rollers 25, 26 and 27, 28 which permit a corresponding escape slippage of the wire 29, provided it is fairly smooth. In both cases, a strict bending torque is applied to the wire 29, that is, no additional forces arise. The bending radius then depends on the particular preset spacing between the rotary disks 14, 15.

Figure 5:
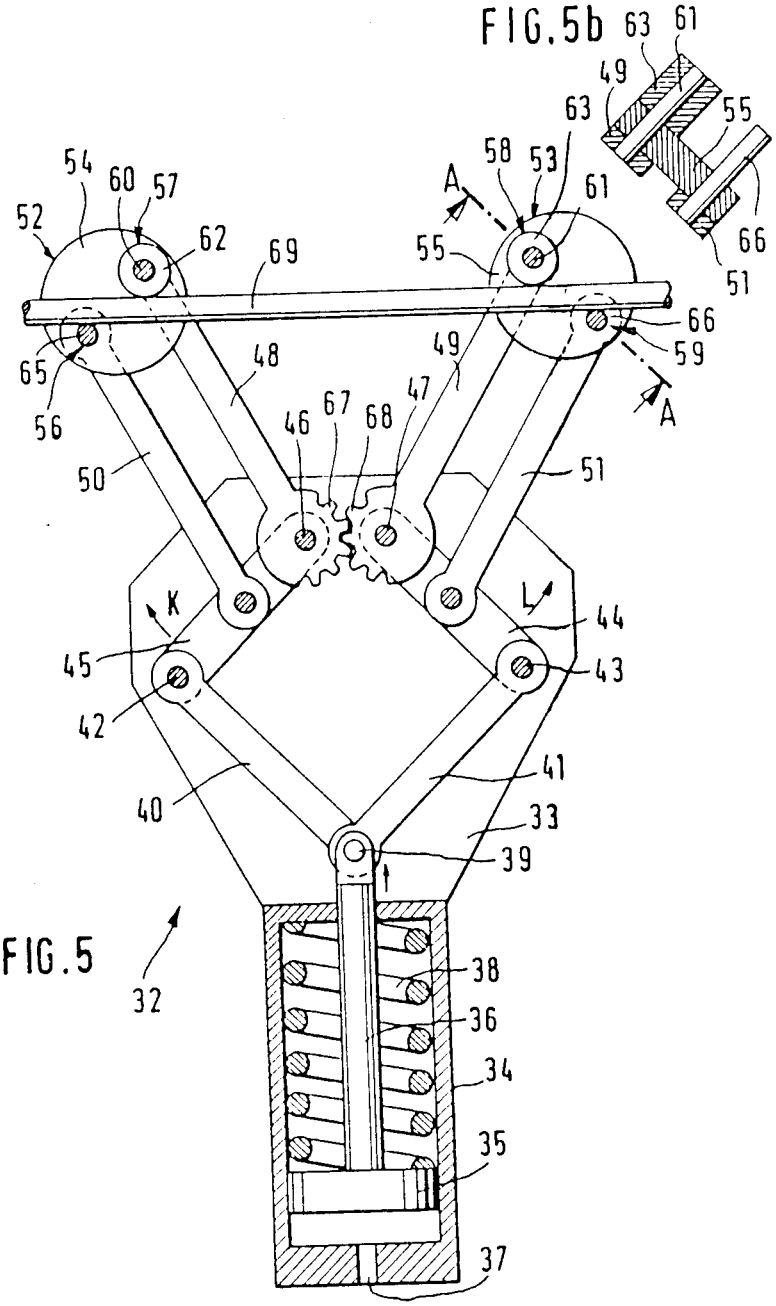
FIG. 5 is a top view partially in section of another bending machine for manual operation, with FIG. 5*b* disclosing a cross section taken along the line A—A of FIG. 5.

FIG. 5 shows another bending machine 32 applicable, in particular, as a portable handtool for use on construction sites. It comprises a base plate 33 supporting a hydraulic cylinder 34 within which moves a piston 35, of which the rod 36 projects upwardly. The lower side of the piston 35 can be loaded through aperture 37. A return spring 38 acts on the other piston side, and forces the piston 35 to retract in the absence of pressure.

The upper and free end of the piston rod 36 is connected to a joint of two pressure-bars, separating like a V. At their other ends, the pressure bars 40, 41 are connected through joints 42, 43 to two drive levers 44, 45, respectively arranged in the manner of an inverted V, and rotatably supported by bolts 46, 47 fixed to the base plate 33. When the piston 35 is pressure-loaded, the pressure bars 40, 41 are forced upwardly and thereby pivot the drive levers 44, 45 in the direction of the arrows K, L about the bolts 46, 47.

Furthermore two guide links 48 and 49 are freely rotatably supported by the bolts 46, 47 respectively. Further guide links 50, 51 run parallel in each case, being suspended in hinging manner from the drive levers 44 and 45, respectively and centrally positioned between the bolts 46 and 47 and the joints 42 and 43 respectively. The guide links 48, 50 and 49, 51 each articulate at their other ends on a bending device 52 and 53. In this manner, the guide links 48, 50 together with the bending device 52 and the guide links 49, 51 together with the bending device 53 form a four-joint kinematics or linkage which can be pivoted toward or away by the drive levers 44, 45.

The bending devices 52, 53 each consist of a rotary disk 54, 55, respectively with bending components 56, 57 and 58, 59 projecting vertically from the plane of the drawing. As particularly clearly shown by the section A—A of FIG. 5*b*, the particular upper bending components 57, 58 consist of a stud bolt 60 and 61 and a roller 62, 63 slipped over it, whereas the lower bending components 56, 59 only consist of a stud bolt 65, 66. All four stud bolts 60, 61, 65, 66 project from the rear side. The guide links 48, 49, 50, 51 are linked to those projections.

In order to retain the mirror symmetry of both four-joint kinematics even when the drive levers 44, 45 are being pivoted, the lower ends of the guide links 48, 49 are equipped with gear sections 67, 68, respectively meshing together. In this manner the motion of the four-joint kinematics will be synchronized.

In the position shown in FIG. 5, a straight wire 69 is placed between the bending components 56, 57, 58, 59. If now the piston 35 is loaded with compressed air through the aperture 37, then it will be forced upwardly together with the piston rod 36 and the pressure bars 40, 41. As a result, the drive levers 44, 45 are pivoted in the direction of the arrows K, L. This simultaneously causing pivoting of the four-joint kinematics, so that the bending devices 52, 53 are rotated simultaneously and thereby apply a torque to the wire 69 at two sites. Therefore, the wire 69 is bent in a sagging way between the bending devices 52, 53, the bending angle depending on the pivot angle of the drive levers 44, 45. The desired bending radius is determined by the spacing between the two bending devices 52, 53 at the beginning of bending. The larger the spacing, the larger too the bending radius that will materialize.

This manual bending machine 32 therefore permits wires to be shaped with the desired bending radius and angle, without thereby having to modify the machine 32 itself at all.

Figure 6:
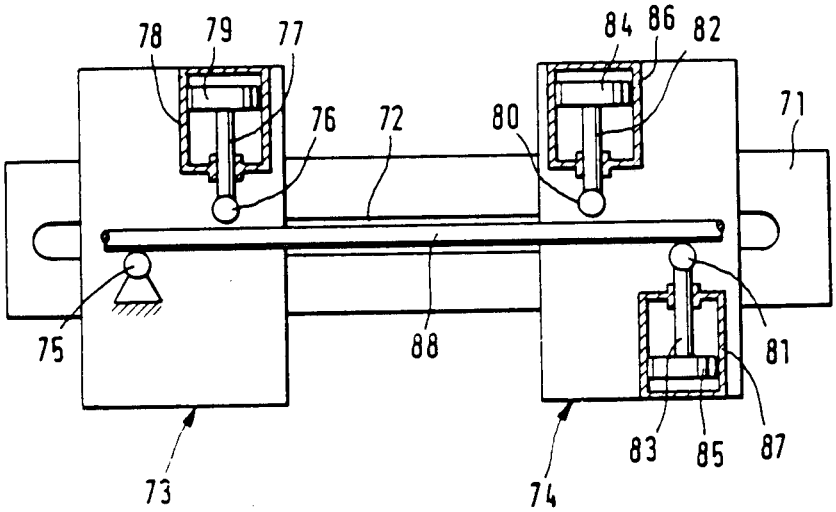
FIG. 6 is a top view of variation of a bending machine.

The bending machine 70 shown in FIG. 6 comprises a bench 71 with a straight slot 72. Two bending devices 73, 74 easily are displacably mounted within this slot 72, but nevertheless they are irrotational. This can be carried out in the same manner as for the illustrative embodiment of FIGS. 1 and 2.

The bending device 73 on the left in this view, comprises a bending component 75, which acts as a support and is fixed to the device 73, and a further bending component 76 spaced from the component 75. The bending component 76 is mounted to the free end of a piston rod 77 extending transversely to the slot 72, and is mounted by its other end to a piston 79 guided within hydraulic cylinder 78. The hydraulic cylinder 78 is fixed on the bending device 73.

The bending device 74, shown on the right in this Figure also comprises two bending components 80, 81, which are spaced apart and, in this case, each is seated on the free end of a piston rod 82, 83 extending transversely to the slot 72 and being guided by pistons 84, 85 in hydraulic cylinders 86, 87. These hydraulic cylinders 86, 87 are fixed on the bending device 74.

A wire 88, still straight, is placed parallel to the slot 72 between the bending components 75, 76, 80, 81, and is shown shortened. Because of the pressure loading on the sides of the pistons 79, 84, 85 away from the piston rods 77, 82, 83, the bending components 76, 80, 81 are forced against the wire 88. In the same manner as for the previously described Figures, a torque is thereby impressed on the wire 88 which then begins to freely bend so as to sag downwardly between the two bending devices 73, 74. The spacing between the two bending devices 73, 74 automatically shortens during this process. Again, the bending radius depends on the spacing between the bending devices 73, 74 at the beginning of bending.

The bending machine 70 shown in FIG. 6 obviously can also be designed in such a manner that it comprises two bending devices 73, or two bending devices 74, each with mirror symmetry.

I claim:

1. A bending machine, comprising:

(a) support means;

(b) first and second spaced cooperating bending means displaceably associated with said support means;

(c) each of said bending means comprises first and second spaced cooperating bending components and the components of said first and second bending means define a first axis extending between said bending means and further define second and third axes extending generally transverse to said first axis and about which a length to be bent may pivot and each of said second and third axes is disposed between the components of one of said bending means and said components of each bending means being sufficiently spaced apart to receive therebetween a length to be bent which extends also between said bending means on said first axis;

(d)

drive means operably associated with at least one of the components of each of said bending means for causing displacement thereof relative to said first axis; and, (e) guide means operably associatd with said support means and with each of said bending means so that displacement of said components by said drive means causes said components to move relative to said first axis and to engage a length to be bent extending between said bending means and received between the associated components and further causes said bending means to move along said guide means relative to each other so that the length pivots about said second and third axes and is bent intermediate said bending means.

2. The machine of claim 1, wherein:

(a) said drive means including a linear actuator operably connected with each of said components.

3. The machine of claim 1, wherein said drive means includes:

(a) means operably connecting said drive means with said bending means for causing said bending means to pivot relative to each other.

4. The machine of claim 1, wherein:

(a)

each of said components includes a sleeve rotatable relative to the associated bending means.

5. The machine of claim 4, wherein:

(a) said drive means including a rotary drive for rotating said bending means about an axis equidistant the associated bending components.

6. The machine of claim 4, wherein said support means comprises:

(a) a bench having a longitudinally extending slot therein; and, (b) means operably associated with each of said bending means are received in said slot for permitting said bending means to move relative to each other.

7. The machine of claim 6, wherein:

(a) said first axis overlying said slot.

8. The machine of claim 6, wherein:

(a) means interconnect each of said bending means with the associated permitting means for allowing said bending means to each rotate relative to the associated permitting means.

9. A bending machine, comprising:

(a) first and second spaced bending devices, each of said devices comprising first and second components and a bending means and each component extending from and defining an axis extending generally transverse to the associated bending means;

(b) first drive means are operably associated with at least one of said components for driving said one component in a direction perpendicular to said axes so that a torque is applied to a length to be bent received between the components of each bending device and extending between said bending devices;

(c) each of said devices is mounted to a pivot system, each of said pivot systems including two guide links and said systems cooperating for defining a four joint kinematics; and, (d) second drive means operably associated with said systems for causing actuation of said systems and thereby operation of said first drive means.

10. Bending machine defined in claim 9, wherein said guide links (48, 50; 49, 51) are parallel to one another and of the same length.

11. Bending machine as defined in claim 9, wherein means hingedly interconnect said guide links (48, 50, 49, 51) and hinge said bending devices (52, 53) about said axes.

12. Bending machine defined by claim 9, wherein a guide link (48) of one bending device (52) is synchronized by a gear unit (67, 68) with one guide link (49) of the other bending device (53).

13. Bending machine as defined by claim 9, wherein two of said guide links (48, 49) rest on a pivot shaft (46, 47) of said four-joint kinematics.

14. Bending machine defined by claim 9, wherein said four-joint kinematics is suspended from a pivotably supported drive bar (44, 45).

15. Bending machine as defined in claim 14, wherein said drive bars (44, 45) subtend a V-shape.

16. Bending machine as defined by claim 14, wherein each of said drive bars (44, 45) has a free end and said free ends are connected to a drive motor (34).

17. Bending machine as defined by claim 16, wherein said drive bars (44, 45) hinge on two pressure bars (40, 41) defining a link quadrilateral, said drive motor (34) is operably associated with said pressure bars.

* * * * *

UNITED STATES PATENT AND TRADEMARK OFFICE

CERTIFICATE OF CORRECTION

PATENT NO. : 4,798,073

DATED : January 17, 1989

INVENTOR(S) : Helmut Dischler

It is certified that error appears in the above-identified patent and that said Letters Patent is hereby corrected as shown below:

Title page Item [56]

References Cited

Foreign Patent Documents

| | | | |
|---|---|---|---|
| 537904 | 10/1931 | Fed. Rep. of Germany . | |
| 1881368 | 8/1963 | Fed. Rep. of Germany . | |
| 1652822 | 9/1971 | Fed. Rep. of Germany . | |
| 2918813 | 11/1980 | Fed. Rep. of Germany .... | 72/217 |
| 200127 | 3/1983 | Fed. Rep. of Germany .... | 72/215 |
| 607617 | 5/1978 | U.S.S.R. ..... | 72/217 |
| 721162 | 3/1980 | U.S.S.R. ..... | 72/217 |
| 1298666 | 12/1972 | United Kingdom ..... | 72/217 |
| 832536 | 9/1938 | France . | |
| 3341714 | 5/1985 | Fed. Rep. of Germany . | |
| 524712 | 12/1953 | Belgium . | |
| 559683 | 12/1930 | Fed. Rep. of Germany . | |
| 49413 | 3/1939 | France . | |
| 2294778 | 7/1976 | France . | |

UNITED STATES PATENT AND TRADEMARK OFFICE

CERTIFICATE OF CORRECTION

PATENT NO. : 4,798,073

DATED : January 17, 1989

INVENTOR(S) : Helmut Dischler

It is certified that error appears in the above-identified patent and that said Letters Patent is hereby corrected as shown below:

Column 6, Claim 1, subparagraph (c):

(c) each of said bending means comprises first and second spaced cooperating bending components rotatable on parallel axes and the components of said first and second bending means define a first axis extending between said bending means and further define second and third axes extending generally transverse to said first axis and about which a length to be bent may pivot and each of said second and third axes is disposed between the components of one of said bending means and said components of each bending means being sufficiently spaced apart to receive therebetween a length to be bent which extends also between said bending means on said first axis;

Column 6, please cancel Claim 2.

UNITED STATES PATENT AND TRADEMARK OFFICE

CERTIFICATE OF CORRECTION

PATENT NO. : 4,798,073

DATED : January 17, 1989

INVENTOR(S) : Helmut Dischler

It is certified that error appears in the above-identified patent and that said Letters Patent is hereby corrected as shown below:

Column 7, Claim 9, subparagraph (a):

(a) first and second spaced bending devices, each of said devices comprising first and second components and a bending means and each component extending from, rotatable on, and defining an axis extending generally transverse to the associated bending means;

Signed and Sealed this

Twenty-second Day of August, 1989

*Attest:*

DONALD J. QUIGG

*Attesting Officer*

*Commissioner of Patents and Trademarks*